United States Patent [19]

Imahashi et al.

[11] Patent Number: 4,627,148

[45] Date of Patent: Dec. 9, 1986

[54] METHOD OF PRODUCING HIGH-PURITY METAL MEMBER

[75] Inventors: Hiromichi Imahashi; Masahisa Inagaki, both of Hitachi; Kimihiko Akahori, Katsuta; Hajime Umehara, Hitachi, all of Japan

[73] Assignee: Hitachi, Ltd., Tokyo, Japan

[21] Appl. No.: 679,075

[22] Filed: Dec. 6, 1984

[30] Foreign Application Priority Data

Dec. 7, 1983 [JP] Japan ..... 58-231036

[51] Int. Cl.[4] ..... B21D 39/00; B23P 11/00

[52] U.S. Cl. ..... 29/516; 29/527.7; 164/469; 164/494; 164/495

[58] Field of Search ..... 164/494, 495, 506, 508, 164/512, 514, 469, DIG. 5; 29/516, 527.7

[56] References Cited

U.S. PATENT DOCUMENTS

| | | | |
|---|---|---|---|
| 2,388,974 | 11/1945 | Hopkins | 164/495 |
| 2,651,668 | 9/1953 | Southern | 164/495 |
| 3,013,315 | 12/1961 | Smith, Jr. | 164/512 |
| 3,152,372 | 10/1964 | Hopkins | 164/497 |
| 3,820,586 | 6/1974 | Takei | 164/506 |
| 4,261,412 | 4/1981 | Soykan et al. | 164/495 X |

FOREIGN PATENT DOCUMENTS

| | | | |
|---|---|---|---|
| 86465 | 1/1966 | France | 164/494 |
| 54-59600 | 5/1979 | Japan . | |
| 56-67788 | 6/1981 | Japan . | |

*Primary Examiner*—Nicholas P. Godici
*Assistant Examiner*—J. Reed Batten, Jr.
*Attorney, Agent, or Firm*—Antonelli, Terry & Wands

[57] ABSTRACT

A high-purity metal member is produced by charging raw material such as sponge zirconium into a cavity of a mold such as a hearth under a vacuum atmosphere; irradiating the material with electron beams to melt it at a limited area of the cavity while forming a molten metal pool and irradiating the pool with the electron beam thereby elevate the molten metal pool to evaporate away impurities therein; and shifting the mold relative to the electron beams to provide a high-purity metal member. The metal pool is limited in its size and irradiated high energy density electron beams so that the temperature is raised whereby the impurities are easily evaporated away. The mold may have an annular cavity. In case of high-purity sleeve formation, the electron beams are irradiated onto the raw material while rotating the mold so that melting and solidification appear in a circumferential direction to be repeated. The impurities are repeatedly exposed to the electron beams.

10 Claims, 12 Drawing Figures

METHOD OF PRODUCING HIGH-PURITY METAL MEMBER

BACKGROUND OF THE INVENTION

This invention relates to a method of producing high-purity metal members. More particularly, it relates to a method of producing members used for lining composite fuel cladding tubes in a nuclear reactor.

The fuel cladding tubes used in a nuclear reactor must have an excellent corrosion resistance, be non-reactive and conduct heat well, have high toughness and ductility, and have a small neutron absorption cross-section.

Zirconium alloys are widely used for fuel cladding tubes, because they meet these requirements.

Fuel cladding tubes made of a zirconium alloy can function very well under steady conditions, but when a great change takes place in load of a reactor there is the danger that they are subject to corrosion or stress cracking, and resultant breakage, because of the corrosive action of iodine gas released from the nuclear fuel pellets contained in the tubes, or the stresses generated by the expansion of nuclear fuel pellets.

In order to prevent such stresses or corrosion cracking in fuel cladding tubes, a barrier made of one of various metals is provided between each cladding tube and the nuclear fuel pellets therein. With cladding tubes made of a zirconium alloy, these tubes are lined with pure zirconium which acts as a metal barrier, which is disclosed in Japanese Patent Laid-Open Publication No. 54-59600/1979. This is because the pure zirconium lining is capable of remaining more flexible than zirconium alloys during neutron irradiation, and has the effect of reducing local strains produced in the zirconium alloy cladding tube to prevent stresses and corrosion cracking.

Experiments performed by the present inventors, however, have disclosed that the zirconium liner must be of an extremely high purity to maintain sufficient flexibility during neutron irradiation. In particular, when used under high-burning conditions, such a zirconium liner must have the purity of crystal-bar zirconium, particularly its low oxygen concentration, to produce the above effects. When the purity is of the sponge zirconium order, a liner can not provide the desired effects, because the degree of hardening due to irradiation is too high.

The crystal-bar zirconium can be obtained by iodinating sponge zirconium and subjecting the resulting iodide to chemical vapor deposition to form zirconium crystal bars. With this method, the reaction speed of the formation of zirconium by the thermal decomposition of zirconium iodide is extremely slow, and is therefore unsuitable for mass production. Thus, zirconium produced by this conventional method is very costly.

A vacuum arc furnace, a resistance-heating furnace, an electron-beam furnace, a plasma-arc furnace, or the like, is generally used for melting metals such as Zr, Ta, Nb, Ti, W, or Mo. The melting method which has the best refining effect is an electron-beam method in which the metal is melted in a high vacuum.

In the conventional electron-beam melting method, electron beams are applied to the metal material to melt it, and the molten metal which pools at the bottom of a crucible is drawn downward while being cooled. According to this method, low melting point impurity elements in the melt can be evaporated away, but impurities with low vapor pressures, such as oxygen, cannot be removed adequately.

Japanese Patent Laid-open Publication No. 56-67788 (1981) discloses a method of forming a nuclear fuel cladding liner by the electron-beam melting method. The publication describes, at page 3, left column, lines 19 and 20 and right column, lines 1 and 2, that a columnar ingot of 50 mm diameter, 500 mm length is formed by using a sponge Zr as a raw material and repeating electron beam melting of it twice in a vacuum atmosphere of $3.0 \sim 8.0 \times 10^{-5}$ torr. From this description, it seems to use a rod melting method wherein members to be melted or a columnar ingot is disposed over a cavity and irradiated with electron beams to melt it, and the molten metal drops into the cavity thereby to form a purified columnar ingot. The rod melting method requires very great energy density to refine the sponge Zr.

SUMMARY OF THE INVENTION

An object of the invention is to provide a method of producing high-purity metal members such as Zr members by effectively elevating molten metal temperature under a vacuum atmosphere so as to evaporate impurities away from the molten metal.

Another object of this invention is to provide a method which is capable of continuously producing high-purity metal sleeves by effecting melting and solidification of a metal such as Zr, Ta, Nb, Ti, W, or Mo in a horizontal plane, while continuously degassing and refining.

The present invention resides in a method of producing high-purity metal members comprising the steps of charging a raw material to be melted of an active metal such as zirconium, tantalum, niobium, titanium, tungsten, or molybdenum into a mold cavity under a high-vacuum atmosphere, irradiating the material on a solid member with a heat source with a high energy density, and melting and solidifying the material in the mold by relatively moving the molten portion to the heat source to continuously form high-purity metal crystals.

According to an aspect of this invention, a commercially available metal powder containing a relatively large amount of impurities, for example sponge zirconium powder, can be charged into a sleeve-shaped or annular mold cavity under a vacuum atmosphere and irradiated with a heat source of a high energy density, such as electron beams, and melting and solidification of the material are repeated to appear in a circumferential direction while moving, in the circumferential direction of the mold cavity, the mold or the heat source to be directed to the material so as to effect repeated degassing and refining reactions and thus accumulate high-purity zirconium crystals.

According to another aspect of the invention, sponge zirconium is charged into a hearth mold, and irradiated with electron beams to form a molten metal pool so that the molten metal is irradiated to raise its temperature as well as the raw material. The hearth mold is gradually shifted to form a zirconium member of high purity.

PREFERRED EMBODIMENTS OF THE INVENTION

The principle of the degassing and refining reactions in an aspect of this invention will now be described taking a sleeve formation method for instance.

Figure 1:
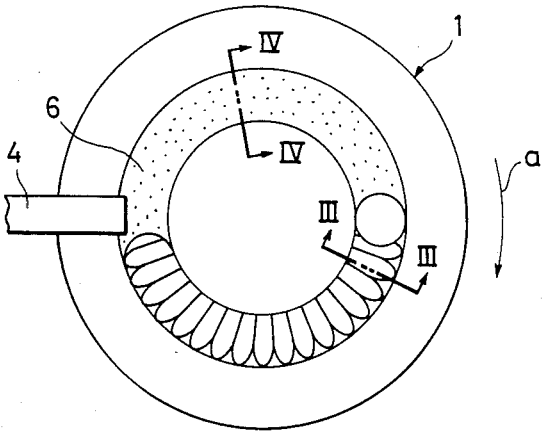
FIG. 1 is a plan view of a mold for explaining an aspect of the present invention.
Figure 2:
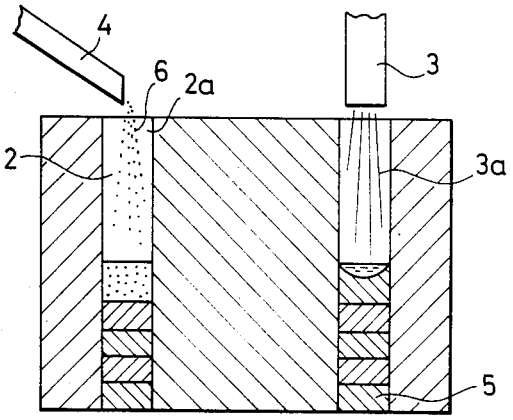
FIG. 2 is a front sectional view of the mold in FIG. 1.

FIG. 1 and FIG. 2 are a plane view and a longitudinally sectioned view for explaining the degassing and refining of zirconium by repeated melting and solidification of a material in an annular mold cavity. Reference numeral 1 denotes a mold provided with an annular cavity 2 which is maintained under a high vacuum. The annular cavity may be a sleeve-shaped one. An irradiator 3 for irradiating a high energy-density heat source such as electron beams and a chute 4 for charging the material to be melted are provided above an opening 2*a* of the mold cavity 2, at suitable positions. A zirconium seed material 5 is laid on the bottom of the mold cavity 2.

To produce a zirconium sleeve using the mold 1, the mold 1 is first rotated in the direction of the arrow a while a predetermined quantity of raw material 6 is continuously poured into the mold cavity 2 from the chute 4, and when the rotation of the mold has reached half-way, electron beams 3*a* are applied toward the bottom of the cavity 2. This operation is repeated to effect repeated melting and solidification of the material, so that a high-purity zirconium sleeve can be produced.

The process of this invention will now be described in detail. An aspect of the present invention is characterized in that (1) the raw material is charged into a mold cavity 2 and is rotated therein relatively to a heat source directed to the material, and (2) the relatively rotating raw material 6 in the cavity 2 is irradiated at least one part thereof with a heat source so as to melt on a solid member. According to this process, the raw material melts each time it is exposed to a heat-source spot and then solidifies until it reaches the next irradiation site within one rotation of the mold 1. This repetition of melting and solidification increases the purity of the molten metal, and a layer of high-purity metal is accumulated in a ring shape.

Figure 3:
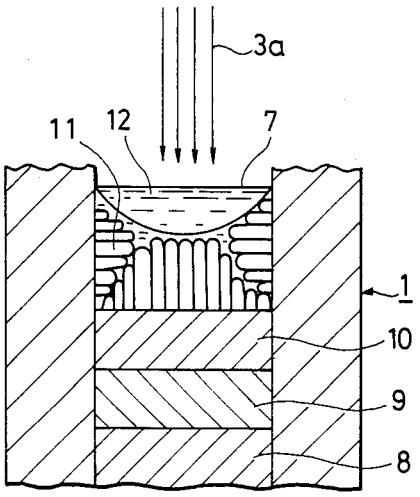
FIG. 3 is an enlarged sectional view taken along the line III—III of FIG. 1.

FIG. 3 is a section taken along the line III—III of FIG. 1, showing how the material solidifies just after passing an irradiation site of an electron beam 3*a*. A molten portion 7 thereof cools as temperature gradients are formed toward the mold 1 and the surface of a solidified layer 10, and high-purity crystals are produced from the inner surface of the mold 1 and the surface of the solidified layer 10 to form a columnar structure 11 orientated toward the center of the cavity where the temperature is highest. A melt with a high impurity concentration remains in the final portion of a melt pool 12, and this melt portion solidifies.

In this way, a zirconium portion which has a high impurity concentration gathers at the surface, so that the zirconium portion with a high impurity concentration is repeatedly exposed to irradiation from the high energy density heat sources to melt and the mold cavity 2 is maintained at a high vacuum during this operation, so that the impurities in the zirconium are gradually evaporated away.

Figure 4:
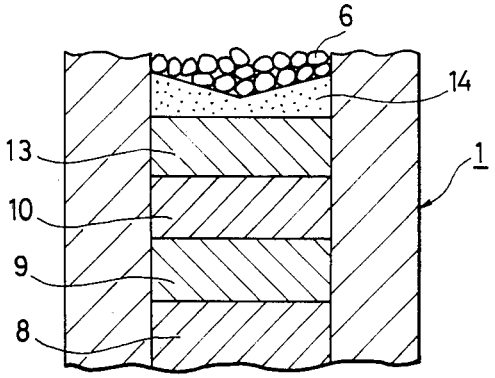
FIG. 4 is an enlarged sectional view taken along the line IV—IV of FIG. 1.

FIG. 4 is a longitudinal section taken along the line IV—IV of FIG. 1, illustrating the condition at the completion of solidification of the melt pool 12 which has passed an irradiation heat source 3. In this stage, a new high-purity layer 13 (corresponding to the columnar crystal structure 11 of FIG. 3) has been formed on the layer 10 which has been formed on a layer 9, formed on a layer 8, and a solidified layer 14 of a high impurity concentration is formed on this layer 13. More material (powder) 6 is supplied on top of this solidified layer 14 to enable the sequential formation of a sleeve-shaped laminate.

Two or more independent heat sources of high energy density can be employed around the circumference of the mold to irradiate the raw material so that a molten portion produced by one of the heat sources is solidified by the time of irradiation with another heat source.

As described above, the present invention provides a novel method of producing a metal sleeve by continuously laminating high-purity metal layers.

Various different heat sources such as vacuum arcs, plasma beams, laser beams, electron beams, etc., can be used in this invention, but it is essential that the heat sources are capable of effecting irradiation under high-vacuum conditions and have a high energy density, so that electron beams are most preferred. The higher the energy density (output/beam area) of a heat source, the more desirable it is for evaporating away impurities. After examining the effect of energy density on the effective reduction of impurities in metals such as Zr, Ta, Nb, Ti, W, and Mo, the present inventors have determined that an energy density of at least 50 $W/mm^2$ is necessary to achieve the desired effect.

EXAMPLE 1

An embodiment of this invention will now be described with reference to FIGS. 5 and 6.

Figure 5:
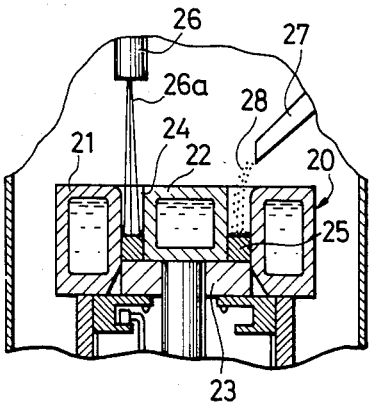
FIG. 5 is part of a sectional view of an example of apparatus for carrying out an embodiment of the present invention.

In FIG. 5, a water-cooled upper mold 20 comprises mainly three parts, that is, an outer mold 21, an inner mold 22 and a base plate 23. The outer mold 21 is water-cooled and has a cylindrical inner face. The inner mold 22 is water-cooled and has an outer cylindrical face. The outer mold 21 and the inner mold 22 are disposed coaxially with a spacing therebetween to form an annular cavity 24. The base plate 23 forms the bottom of the cavity 24. In the cavity 24, a seed metal member 25 of Zr is disposed. An electron gun 26 is provided over the cavity 24 to irradiate electron beams 26*a* on the seed metal member 25 and a material to be melted. A chute 27 is provided over the cavity 24 at a position angularly spaced from the electron beam passage to feed a raw material 28 to be melted into the cavity 24.

Figure 6:
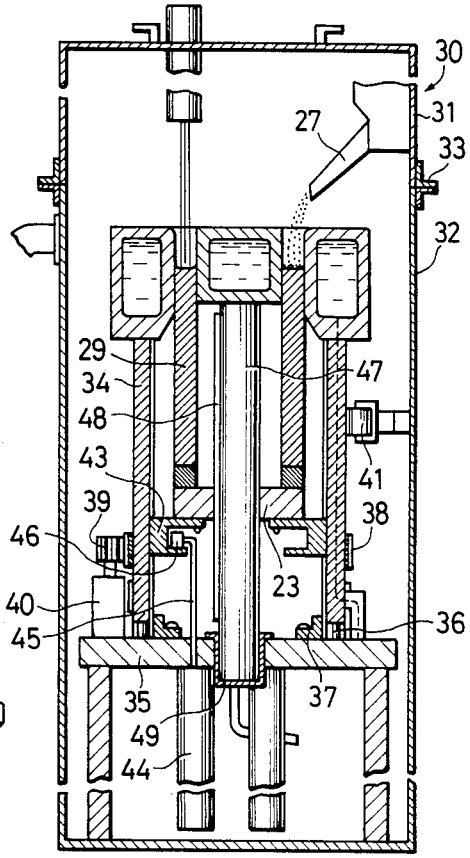
FIG. 6 is a sectional view of the whole apparatus in FIG. 5.

As apparent by referring to FIG. 6, these parts are disposed in a vacuum chamber defined by a casing 30. The casing 30 comprises two separable parts, that is, an upper casing 31 and a lower casing 32. The upper and lower casings are airtightly joined at flanges 33.

The mold 20 is provided with a mechanism for rotating about the axis thereof to make a relative rotational movement between electron beams 26a and a sleeve to be formed of a raw material 28 being fed into the cavity 24, and a mechanism for drawing a solidified metal sleeve 29 downward. Namely, the outer mold 21 is supported by a cylindrical support 34 the lower end of which is provided with rollers 36 to roll on a rest 35 guided by a guide 37, secured to the rest 35. The upper portion of the support 34 also is guided by roller 41 secured to the lower casing 32. The base plate 23 is rigidly connected to a connector 43. The connector 43, which is ring-shaped and has an annular recess, is slidably inserted in a vertical groove formed in the support 34. In the recess, a roller 46 is disposed. The roller 46 is connected to a hydraulic cylinder 44 by a connecting rod 45. The cylinder 44 actuates the base plate 23 upward or downward while allowing it to rotate. The inner mold 22 is supported by a ram 47 with a key-like projection 48. The ram 47 passes through the base plate 23 to move freely in a vertical direction, but not to rotate because of restriction of the key-like projection 48.

The lower end of the ram 47 is rotably supported by a bearing 49 secured by the rest 35. The cylindrical support 34 is rotated by a motor 40 through a pinion 39 provided on the motor 40 and a ruck 38 secured to the support 34. The rotation is transferred to the base plate 23 through the connector 43 and to the rod 47 by the key-like projection 48. Thus, the mold 20 comprising the inner mold 21, the outer mold 22 and the base plate 23 is to be rotated by the motor 40. The metal sleeve 29 of solidified metal layer is gradually lowered by means of the hydraulic cylinder 44 while allowing the mold 20 to rotate.

The material being worked is supplied at appropriate timing through the chute 27.

Using the apparatus described above, Zr sleeves were produced continuously according to the process of this invention.

Commercially available zirconium sponge used in nuclear reactors was used as the raw material. Table 1 shows the various melt conditions, for the electron beam (output and energy density), rotational speed of mold and descending speed of ram (drawing-out speed), used in the production.

TABLE 1

| Run No. | Output (kW) | Energy density (W/mm$^2$) | Rotational speed (rpm) | Descending speed (mm/min) |
|---|---|---|---|---|
| 1 | 6.5 | 36.8 | 6 | 5 |
| 2 | 9.0 | 51.0 | 6 | 5 |

TABLE 1-continued

| Run No. | Output (kW) | Energy density (W/mm$^2$) | Rotational speed (rpm) | Descending speed (mm/min) |
|---|---|---|---|---|
| 3 | 11.0 | 62.3 | 6 | 5 |
| 4 | 27.5 | 155.7 | 6 | 5 |
| 5 | 50.0 | 283.1 | 6 | 5 |
| 6 | 50.0 | 283.1 | 1 | 5 |
| 7 | 50.0 | 283.1 | 30 | 5 |
| 8 | 50.0 | 283.1 | 60 | 5 |

Note:
The rotational speed is that of the mold and the descending speed that of the ram.

Other production conditions were as shown in Table 2 below.

TABLE 2

| | |
|---|---|
| Electron beam diameter | 15 mmϕ |
| Degree of vacuum | $1 \times 10^{-4}$ Torr |
| Mold | Water-cooled copper mold |
| Material (powder) | 50–100 mesh Zr |
| Material feed rate | 130 g/min |

The sleeves produced under the conditions shown in Tables 1 and 2 had an outer diameter of 100 mm, an inner diameter of 70 mm, and a length of 500 mm.

Table 3 compares the results of analysis of impurities in the raw material powder and in a zirconium sleeve produced under the conditions of Run 5 in Table 1.

TABLE 3

(unit: ppm)

| Material | Element | | | | | | | | | | | | | | | | | |
|---|---|---|---|---|---|---|---|---|---|---|---|---|---|---|---|---|---|---|
| | O | H | N | Al | B | Cd | C | Cl | Co | Cr | Fe | Hf | Mg | Mn | Mo | Ni | Si | Sn |
| Raw material | 810 | 7 | 24 | 33 | <0.3 | <0.5 | 100 | 70 | <10 | 140 | 1030 | 79 | 180 | 40 | <10 | <10 | <30 | <20 |
| Zr sleeve according to Run 5 of Table 1 | 121 | 4 | 20 | <25 | <0.3 | <0.5 | <50 | <10 | <5 | <10 | 53 | 75 | <10 | <10 | <10 | <10 | <10 | <10 |

As is apparent from the table, zirconium sleeves produced according to the process of this invention had greatly reduced contents of the impurity elements O, C, Cr, Fe, Cl, Mg, and Mn, compared with the raw material powder. As a result, the purity of the Zr was increased from 99.74% to 99.96%. No significant difference was seen between the impurity distribution in the longitudinal direction and that in the diametrical direction of each sleeve, and the impurity distributions in both directions were substantially uniform.

EXAMPLE 2

Nb sleeves were produced using the apparatus of Example 1 (FIGS. 5 and 6). The raw material was commercial grade Nb ASTM R04210.

The melting conditions were those of Run 4 in Table 1 and other production conditions were the same as those of Example 1. The produced Nb sleeves had an outer diameter of 100 mm, an inner diameter of 70 mm, and a length of 500 mm.

Table 4 shows the results of analysis of impurities in the raw material powder and in the Nb sleeves of this invention produced under the conditions of Run 4 in Table 1.

As is apparent from the table, the Nb sleeves produced according to the process of this invention had markedly reduced contents of the impurity elements O, C, Fe, Si, Ni, and Al in comparison with the raw material. The purity of the Nb was increased from 99.79% to 99.86%.

TABLE 4

(units: ppm)

| Material | Element | | | | | | | | | | | | |
|---|---|---|---|---|---|---|---|---|---|---|---|---|---|
| | O | H | N | C | Zr | Ta | Fe | Si | W | Ni | Mo | Hf | Al |
| Raw material | 250 | 10 | 25 | 100 | 100 | 1000 | 100 | 50 | 100 | 50 | 50 | 200 | 50 |
| Nb Sleeve according to Run 4 in Table 1 | 10 | 10 | 20 | <50 | 80 | 900 | 20 | 40 | 100 | <10 | 50 | 100 | <10 |

EXAMPLE 3

Figure 7:
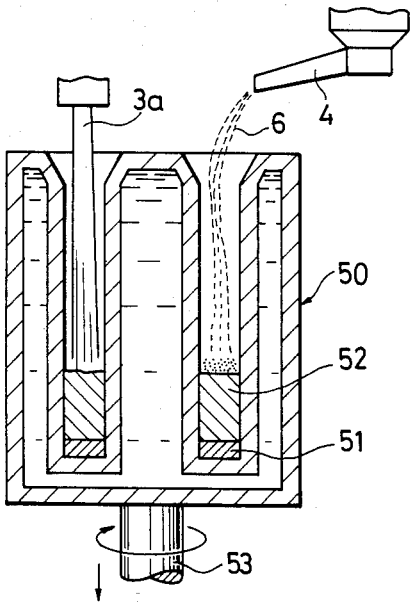
FIG. 7 is a front sectional view of another example apparatus for carrying out any embodiment of the present invention.
Figure 8:
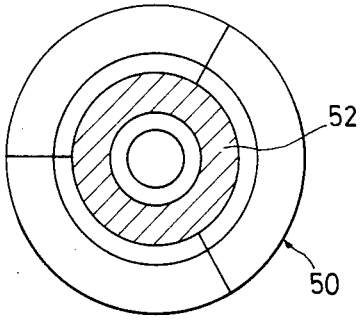
FIG. 8 is a plan view of the apparatus of FIG. 7.

In this Example, Zr sleeves were produced according to the process of this invention by rotating the mold itself. In the apparatus used in this example, as shown in FIGS. 7 and 8, the lower side of the cavity of a mold 50 is closed and a ram 53 is attached securely to the bottom center of the mold 50. The ram 53 can rotate and also move vertically. Zr seed members 51 are provided at the bottom of the mold cavity. An electron beam irradiator 3 and a chute 4 are provided above the opening of the mold 50. It must also be noted that the mold 50 is a split type which allows the easy removal of the produced sleeve, as shown in FIG. 8. When producing a Zr sleeve using this apparatus, the raw material is supplied onto the Zr seed members 51 in the mold cavity from the chute 4 while the ram 53 is rotating, and then the electron beam 3*a* is applied onto the charged material, so that high-purity solidified layers are piled up successively. According to this method, the mold 50 is pulled down by the ram 53 as the pile of solidified layers grows, and melting and solidification are repeated until the mold cavity is filled with solidified Zr layers. When a Zr sleeve 52 of a desired length has been produced, the split mold 50 is separated, so that the sleeve 52 could be removed.

EXAMPLE 4

Zr sleeves were produced under the production conditions of Runs 1–4 and 6–8 of Table 1 in Example 1, and the relationship between oxygen content in the obtained Zr sleeves and melting conditions, that is, the energy density of the electrom beam and the rotational speed of the mold, was examined.

Figure 9:
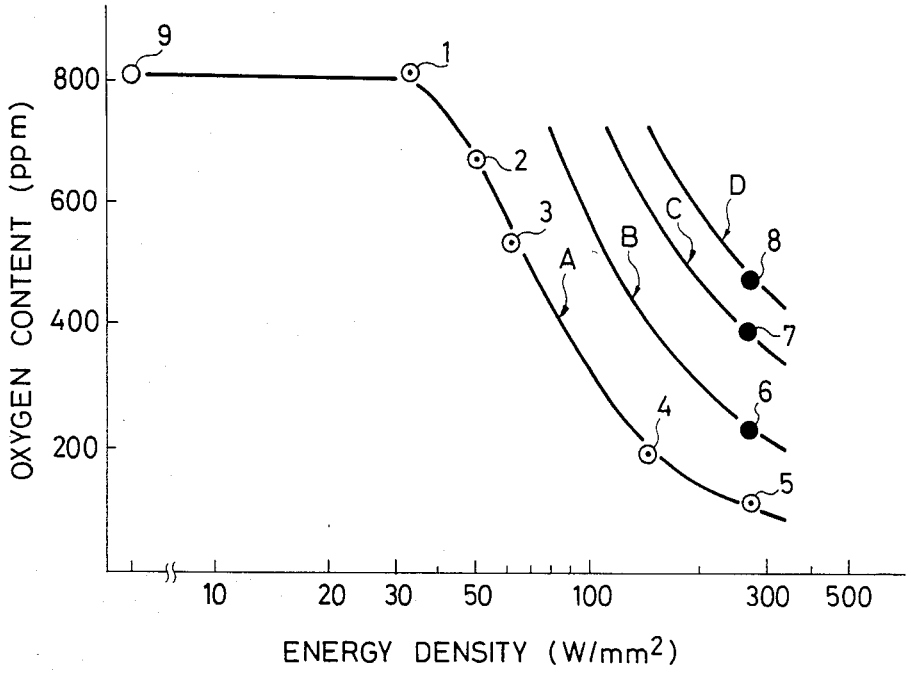
FIG. 9 is a graph showing a relationship between energy density of electron beams and oxygen concentration of molded sleeves.

FIG. 9 is a graph of the relationship between energy density of the electron beam and oxygen content on the results obtained according to Runs No. 1–8 and a raw material. As can be seen from the graph in which reference numerals correspond to Run No., the raw material is referred to as a numeral 9 A, B, C, D indicate characteristic curves showing the relationships between energy density of the electron beam and oxygen content at 6, 1, 30 and 60 rpm, respectively, it was found that an energy density of at least 50 W/mm$^2$ is necessary for reducing the oxygen content of the Zr sleeves. It is also important to select an appropriate rotational speed for the mold. If the speed is too low, such as below 1 r.p.m., solidified layers with high impurity concentrations will be formed and pile up. On the other hand, if the rotational speed exceeds 60 r.p.m., orientated solidification does not occur, and so high-purity layers are not formed in the lower part of the laminate.

Figure 10:
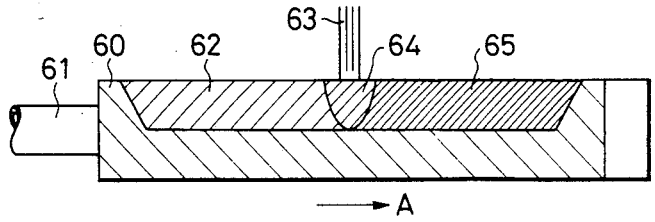
FIG. 10 is a sectional view of a hearth mold.

Another embodiment in which a hearth mold is used for forming a high-purity Zr ingot for fuel cladding liners will be described hereinafter referring to FIG. 10.

The hearth mold 60 which is made of copper and cooled with water passing through a pipe 61 is disposed horizontally in a vacuum atmosphere. A raw material 62 of Zr sponge is charged into the hearth 60 and irradiated with electron beams 63, whereby the material 62 is melted at a limited area of the hearth to form a relatively small molten metal pool on the hearth. The hearth is shifted gradually horizontally in a direction of A so that a new molten metal pool 64 is formed and leaves solidified pure zirconium 65. Thus, high-purity zirconium bar ingot or rod having a shape similar to the cavity of the hearth 60 is formed. The melting can be repeated at least once. The bar ingots are remelted in a vacuum or inert gas atmosphere to form a columnar ingot for a liner of the composite nuclear fuel cladding, which will be described later.

As a raw material, a Zr sponge or its melted material of an oxygen concentration of more than 400 ppm, total impurities other than oxygen of 1000~5000 ppm is used in a form of powder, rod or sheet.

In order to raise the purity of the zirconium sponge by electron beams, it was found that the energy density is the most important. And in order to effectively use the energy, it is necessary to dispose the raw material on the hearth and irradiate the material with electron beams to form a relatively small molten metal pool whereby the molten metal pool also is irradiated by the electron beams to raise the temperature of the molten metal pool surface to evaporate away the oxygen in a form of ZrO.

Figure 11:
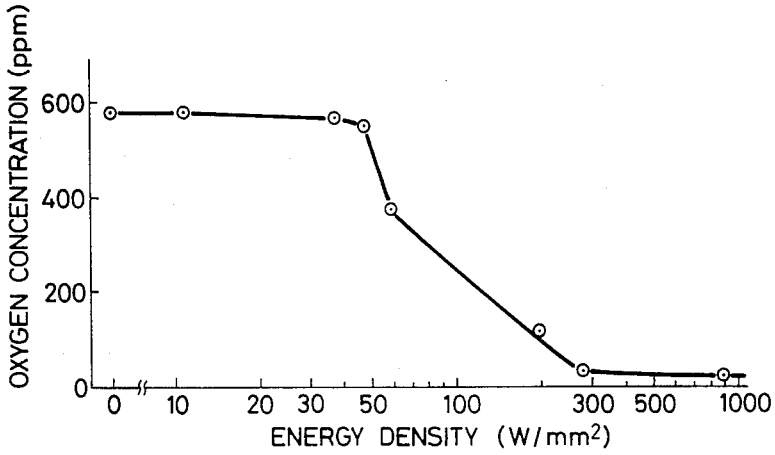
FIG. 11 is a graph showing a relationship between oxygen concentration and energy density.

In FIG. 11, a relationship between oxygen concentration of the zirconium and energy density of the beam during melting. One effect is that oxygen concentration is lowered at an energy density of more than 50 W/mm$^2$. As for the vacuum atmosphere, higher vacuum is more preferable, however, since the evaporation pressure of Zr is $4\times10^{-5}$ torr at a melting temperature of 2200 k, too high vacuum is not preferable because of large evaporation loss of the Zr. Therefore, the vacuum of $10^{-4}\sim10^{-6}$ torr is preferable.

Table 5 shows electron beam melting conditions using the hearth.

TABLE 5

| Run No. | Output (kW) | Vacuum (torr) | Energy density (W/mm$^2$) | Melting energy (J/mm$^3$) |
|---|---|---|---|---|
| 10 | 0.9 | $4\times10^{-5}$ | 47.2 | 35.1 |
| 11 | 1.2 | $2\times10^{-5}$ | 61.1 | 45.5 |
| 12 | 2.9 | $2\times10^{-5}$ | 150.5 | 112.3 |
| 13 | 1.4 | $4\times10^{-5}$ | 278.5 | 135.2 |

Table 6 shows the analysis results of impurity elements in the raw material used in the examples 10 to 13 (Run No. 10 to 13). The raw materials of Run No. 10 to 12 are sponge zirconium of ASTM B-351-79 grade R60001, each of which is a rod of 8 mm diameter. The raw material of example 13 is powder of reactor grade zirconium.

TABLE 6

(Unit: ppm)

| Run No. | O | H | N | Al | B | Cd | C | Co | Cr | Cu | Fe | Hf | Mg | Pb | Nb | Ni | Si | Sn | W | U |
|---|---|---|---|---|---|---|---|---|---|---|---|---|---|---|---|---|---|---|---|---|
| 10,11,12 | 580 | 8 | 20 | <25 | <0.4 | <0.4 | <50 | <10 | 145 | <10 | 670 | 79 | <10 | <10 | <10 | <10 | <30 | <20 | <50 | <1 |
| 13 | 750 | 8 | 13 | 40 | 0.5 | <0.5 | <50 | <5 | 99 | <10 | 517 | 82 | 25 | <10 | <10 | <30 | 22 | <20 | <10 | <1 |

Table 7 shows comparison of the hearth melting and rod melting by electron beams under vacuum atmosphere, with respect to the concentration of oxygen, nitrogen and hydrogen.

TABLE 7

| | Electron beam hearth melting | | | Electron beam rod melting | | |
|---|---|---|---|---|---|---|
| Melting times | O | N | H | O | N | H |
| (Raw material) | 750 | 13 | 8 | 780 | — | — |
| 1 | 275 | 4 | 11.3 | 661 | 73 | 3.8 |
| 2 | 223 | 2 | 3 | 540 | 9 | 1.3 |
| 3 | 215 | 10 | 2.6 | 593 | 8 | 3.2 |
| 4 | 131 | 19 | 4.7 | 537 | 19 | 3.0 |
| 5 | 96 | 16 | 5.1 | 555 | 13 | 3.3 |
| 6 | 42 | 15 | 3.9 | — | — | — |

As is apparent from Table 7, the electron beam hearth melting has a great effect of reducing oxygen amount in the sponge zirconium compared with the electron beam rod melting. In the electron beam hearth melting, Zr ingots of oxygen concentration less than 300 ppm can be obtained by melting once.

Figure 12:
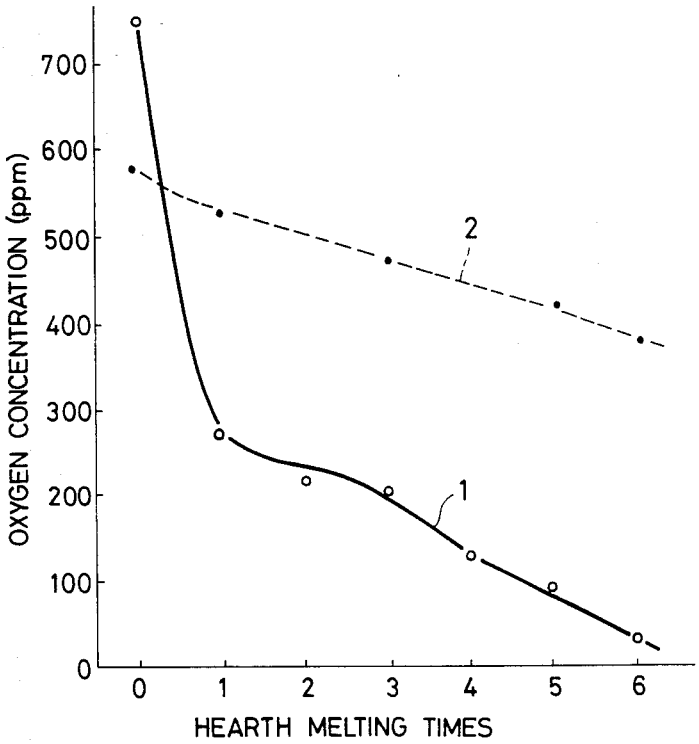
FIG. 12 is a graph showing relationships between oxygen concentration and hearth melting times.

FIG. 12 shows relationship between melting times and oxygen concentration of Run No. 11 and 13. In FIG. 12, curves 1 and 2 show Run Nos. 13 and 11, respectively. Both show that the oxygen concentration decreases as melting times increases. Run No. 13 is much greater in its decreasing extent than Run No. 11. The higher the energy density, the more the oxygen concentration decreases.

When oxygen concentration decreases to about 210 ppm, its Vickers hardness becomes less than 100 (Hv), so that the zirconium bar purified by the electron beam hearth melting has a hardness equivalent to a crystal-bar grade Zr.

A lot of Zr ingot pieces according to Run No. 13 were produced. The ingots were melted in an electron beam melting furnace to form a large scale ingot of 56 mm diameter and 300 mm length. The large scale ingot had the same oxygen concentration as in the ingot pieces, that is, about 200 ppm.

According to a conventional method, a composite fuel cladding is formed.

As an outer billet, a Zr alloy tube of outer diameter of 79.30 mm, inner diameter 34.55 mm, length 250 mm (the alloy comprises, by weight, 1.52% Sn, 0.11% Cr, 0.13% Fe, 0.05% Ni and balance Zr.) is formed. An inner billet is produced by reducing the above-mentioned Zr ingot into a pipe of outer diameter of 32.55 mm, inner diameter of 21.25 mm and length of 253 mm. The inner billet is inserted into the outer billet to form a double pipe. The pipe is subjected to hot extrusion, cold rolling and annealing. An example of the scale of the finished pipe is inner diameter 10.81 mm, thickness 0.86 mm, and thickness of a liner 75 μm.

Ultra-sonic test and observation of the sectional area found that the liner and the outer pipe have no faults all over the length and a good metal joining done. The oxygen concentration of the liner is not changed.

The process of this invention is capable of producing high-purity metal members on a mass-production basis and at a low cost, and thus the invention has the prominent effect of making it easy to produce nuclear reactor members and superconducting materials with a high reliability and quality.

What is claimed is:

1. A method of producing a composite nuclear fuel cladding comprising an outer tube of zirconium alloy and a liner of pure zirconium, which comprises the steps of:

charging a raw material of sponge zirconium into a hearth disposed horizontally under a high vacuum atmosphere;

irradiating the raw material with an electron beam having a density of at least 50 W/mm$^2$ to melt the raw material in a limited area and to evaporate away impurities from the molten raw material;

shifting the hearth in its lengthwise direction to provide high purity ingots of zirconium;

forming a columnar ingot by remelting said ingots;

forging said columnar ingot;

perforating said columnar ingot to form a sleeve;

reducing the sectional area of said sleeve by rolling to form a liner, said liner being inserted into said outer tube; and subjecting said liner inserted in said outer tube to hot extrusion, cold rolling and annealing.

2. A method of producing high-purity metal members, which comprises the steps of:

charging a raw material of metal into a cavity of a mold under a vacuum atmosphere;

irradiating an upper portion of said material with a heat source which provides a high energy spot with a density of at least 50 W/mm$^2$ to form a molten metal pool at a limited area within said mold cavity, said molten metal pool being irradiated by the spot of high energy from said heat source to raise its temperature, thereby evaporating away impurities in the material under said vacuum atmosphere; and shifting said mold relative to the heat source in a horizontal plane to enable solidification of the molten metal and formation of another molten metal pool, in turn, thereby to provide a high-purity metal member extending along a direction in which said mold is shifted.

3. The method as defined in claim 2, wherein said raw material comprises sponge zirconium and said heat source is electron beams.

4. The method as defined in claim 3, wherein said mold is a hearth mold having a rod-like cavity.

5. A method of producing a high-purity metal sleeve, which comprises the steps of:

charging a raw material of metal into a sleeve-shaped mold cavity disposed vertically under a vacuum atmosphere;

irradiating an upper portion of said raw material with a heat source providing a high energy spot with a density of at least 50 W/mm$^2$ to form a small molten metal pool in a limited area of said mold cavity along a horizontal plane and to evaporate away impurities included in the molten metal pool under said vacuum atmosphere;

rotating said mold cavity about a central axis;

solidifying said pool of molten metal in said mold cavity along a horizontal plane;

charging additional raw material on an upper surface of a solidified metal; and irradiating the additional raw material on the solidified metal with said heat source so as to melt the additional raw material and a part of said solidified metal thereby providing another small molten metal pool and to evaporate away impurities contained in said another molten metal pool along a horizontal plane, whereby impurities are repeatedly exposed to irradiation during rotation of said mold cavity.

6. The method of producing a high-purity metal sleeve according to claim 5, wherein said raw material is a high-melting point active metal which is selected from the group consisting of zirconium, tantalum, niobium, titanium, molybdenum, and tungsten.

7. The method of producing a high-purity metal sleeve according to claim 5, wherein said heat source providing said high energy spot comprises an electron beam.

8. The method of producing a high-purity metal sleeve according to claim 5, wherein at least two independent heat sources of high energy density are irradiated around the circumference of said mold, so that a molten portion produced by one of said heat sources is solidified by the time of irradiation by another heat source.

9. The method of producing a high-purity metal sleeve according to claim 5, wherein said mold cavity rotates at 1–60 rpm.

10. A method of producing a high-purity metal sleeve, which comprises the steps of:

charging a raw material of a sponge zirconium powder into a mold with an annular cavity disposed vertically under a vacuum atmosphere;

vertically irradiating an upper portion of said raw material with a round cross-sectional electron beam to melt said raw material thereby forming a small molten metal pool and to evaporate impurities within said pool;

rotating said mold around a central axis;

solidifying the molten metal; and irradiating an upper portion of the solidified metal and additionally charged raw material at the same time with the electron beam to melt both the solidified metal and the additionally charged raw material, whereby melting and solidification are repeated along a circumferential direction of said mold to provide the continuous accumulation of high-purity crystals, while evaporating away impurities by the irradiation under said vacuum atmosphere.

* * * * *